US005170597A

United States Patent [19]

Stearns

[11] Patent Number: 5,170,597

[45] Date of Patent: Dec. 15, 1992

[54] ROOF FLASHING WITH IMPROVED DRIP GUARD

[76] Inventor: Carl D. Stearns, 212 Scottholm Blvd., Syracuse, N.Y. 13224

[21] Appl. No.: 874,035

[22] Filed: Apr. 27, 1992

[51] Int. Cl.[5] ..... E04D 13/15

[52] U.S. Cl. ..... 52/58; 52/11; 52/94; 52/97

[58] Field of Search ..... 52/97, 96, 94, 95, 58, 52/11, 12

[56] References Cited

U.S. PATENT DOCUMENTS

| | | | |
|---|---|---|---|
| 180,967 | 8/1876 | Valentine | 52/97 |
| 594,262 | 11/1897 | Merry | 52/97 |
| 848,537 | 3/1907 | Davis | 52/11 X |
| 1,406,757 | 2/1922 | Prudes | 52/96 X |
| 3,188,772 | 6/1965 | Tennison, Jr. | 52/11 X |
| 4,385,010 | 5/1983 | Bosne | 52/11 X |
| 4,404,775 | 9/1983 | Demartini | 52/11 X |

*Primary Examiner*—David A. Scherbel
*Assistant Examiner*—Robert Canfield
*Attorney, Agent, or Firm*—Charles S. McGuire

[57] ABSTRACT

A flashing structure for installation along a roof edge to aid in proper drainage of moisture run-off. The sheet metal flashing includes a planar body portion for installation under the shingles or other roof covering and extending from a free edge to a parallel drainage edge. The flashing is bent at the drainage edge to extend back under and away from the body portion in a continuous curve, preferably of constant radius, for about 180°. The flashing is bent again at an angle of less than 90° at the juncture of the curved portion and a flat portion which extends from the juncture edge to a drip edge where the material is bent back upon itself to provide a portion extending to a terminal edge.

14 Claims, 2 Drawing Sheets

ROOF FLASHING WITH IMPROVED DRIP GUARD

BACKGROUND OF THE INVENTION

The present invention relates to flashing structures for installation along roof edges, and more particularly to roof flashings having a configuration providing improved performance and appearance.

For many years it has been a common practice to install flashing along the edges of roof structures in order to protect the material under the shingles or other exterior roof covering, as well as the fascia, molding and other materials below the roof line, from the effects of moisture. As rain and other forms of precipitation run off a roof surface at a horizontal edge, there is a tendency for moisture to infiltrate beneath the exterior roof covering, accelerating decay of the underlying materials. Also, particularly where eaves troughs are not installed to receive and drain away the run-off at the roof edges, the moisture will rapidly cause damage to the building materials below the roof line.

Flashing structures intended to combat the deleterious effects of such moisture have typically been of the types known as "drip edge" and "rake edge". While such structures have provided a degree of protection for the roof materials, they are often deficient in preventing the deposit of moisture on materials below the level of the roof edge. This deficiency has been particularly evident in buildings having decorative molding or trim installed immediately below a roof edge from which moisture runs off. Such molding is commonly found on older buildings, and in architectural applications intended to impart a historic, or enhanced decorative appearance to the exterior of the structure.

It is the principal object of the present invention to provide a novel and improved flashing structure for installation at roof edges, principally horizontal edges, where precipitation run-off occurs.

More specifically, an object of the invention is to provide a roof flashing with improved ability to divert precipitation run-off away from building materials immediately below a roof edge.

A further object is to provide a roof flashing which is both visually attractive and operationally effective.

Other objects will in part be obvious and will in part appear hereinafter.

SUMMARY OF THE INVENTION

The roof flashing of the present invention includes the usual flat body portion, commonly on the order of four inches in width, for attachment to the roof structure adjacent a horizontal edge thereof. The body portion of the flashing is installed in covering relation to the roof structure which lies immediately beneath the shingles or other materials forming the exterior roof surface. The flashing body is partly or fully covered by the exterior roofing material.

The flashing is preferably constructed of a single piece of sheet metal of any desired length, formed by bending in accordance with conventional techniques to the desired configuration. The planar body portion extends from a linear free edge to a parallel drainage edge which lies outwardly adjacent the horizontal edge of the roof. The metal is bent in a rather sharp break along the drainage edge to extend in a gradually curved bend rearwardly (i.e., back toward the free edge) and thence downwardly (away from the body portion) and forwardly to a bend providing another linear edge, parallel to and spaced from the drainage edge. From this linear edge, a flat portion extends outwardly and downwardly to a drip edge. The flashing is preferably bent at 180°, to extend back upon itself for a short distance from the drip edge.

When installed along a roof edge, the portion of the flashing extending downwardly from the drainage edge is generally C-shaped in side view, ensuring that water from the roof drips free of all building materials. The water coming off the drainage and/or drip edge may drain either into an underlying eaves trough or to the ground. In any case, the flashing is so positioned with respect to underlying building materials, e.g., crown molding and/or fascia boards, that water draining from the roof is diverted away from such materials regardless of how minimal the roof slope may be.

The foregoing and other features of construction and operation of the invention will be more readily understood and fully appreciated from the following detailed description, taken in conjunction with the accompanying drawings.

DETAILED DESCRIPTION

Figure 1:
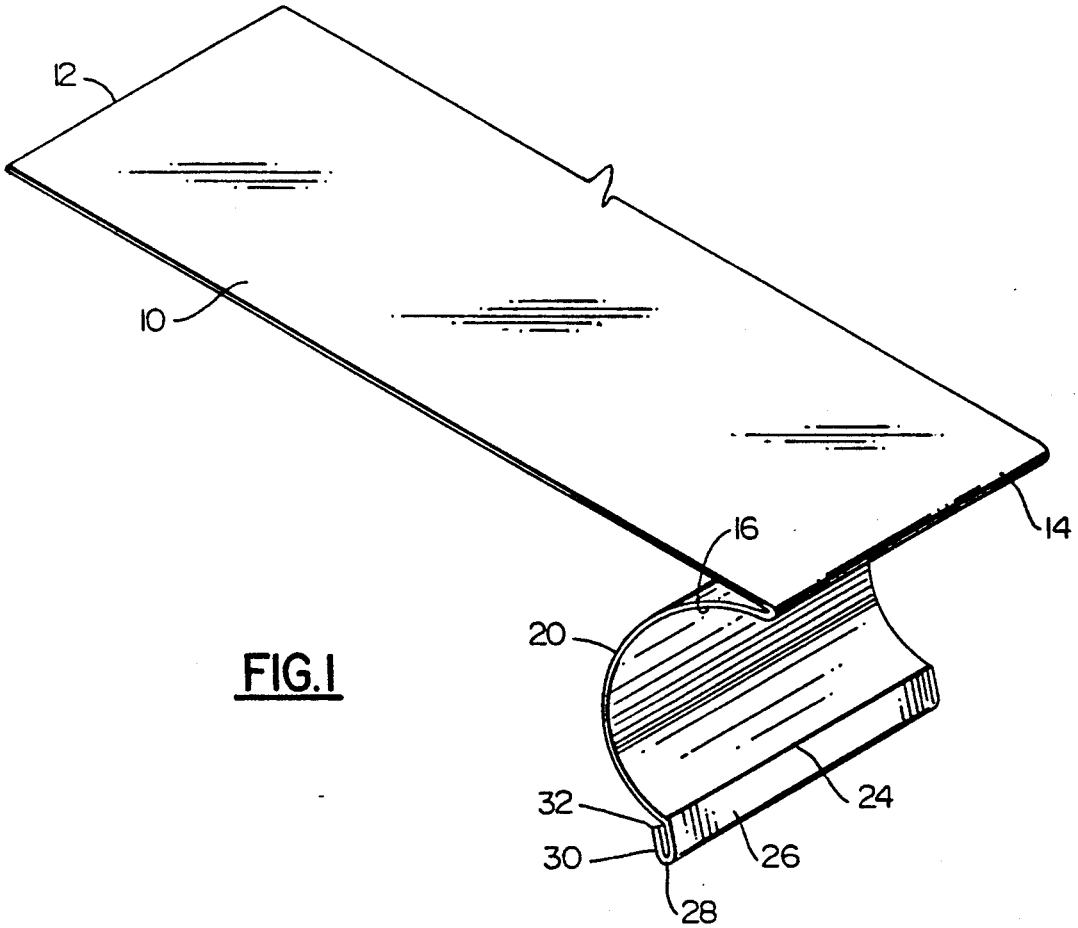
FIG. 1 is a perspective view of the preferred embodiment of the invention.

The flashing of the invention is formed from a single layer of sheet metal (aluminum, galvanized, terne metal, lead-coated copper, and the like) having a suitable thickness, e.g., 26 gauge galvanized and a length preferably of at least four feet. The flashing includes flat body portion 10 extending between free edge 12 and parallel drainage edge 14. The flashing material is formed to the desired shape by conventional techniques, employing a sheet metal break, with radius bars if desired. At drainage edge 14 the material is bent sharply at essentially 180°, extending back toward free edge 12 below the lower surface of body portion 10 (the surface visible in FIG. 1 being considered the upper surface).

Figure 2:
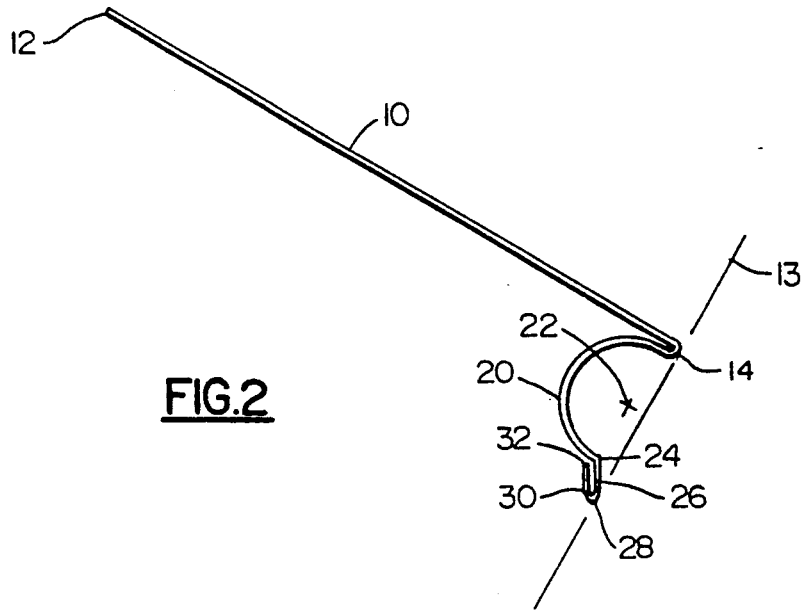
FIG. 2 is a side elevational view of the flashing of FIG. 1.

From edge 14 the flashing material is bent to curve rearwardly and downwardly, away from body portion 10, and thence forwardly, toward a plane perpendicular body portion 10 and tangent to drain edge 14, such plane being indicated in FIG. 2 by reference numeral 18. Curved portion 20 extends for approximately 180° at a preferably uniform radius about center point 22 from edge 14 to edge 24, thus presenting rearwardly (toward free edge 12) and forwardly directed surfaces. It will be noted that point 22 is positioned rearwardly (i.e., towards portion 20) of plane 18. The radius of curvature of portion 20 is preferably between about ½" and ¾". The flashing material is bent at an angle of less than 90° to provide edge 24 and flat portion 26 extending therefrom (i.e., the angle between portion 26 and a line tangent to portion 20 and extending past edge 24 is less than 90°). Portion 26 extends from edge 24 to drip edge 28, formed by bending the material back upon itself at a sharp 180° bend. Portion 30 extends from drip edge 28, in closely superposed, parallel relation to the rearwardly directed surface of portion 26, to terminal edge 32.

The manner of installation of the flashing on typical roof structures with several of the more popular forms of crown molding and with flat fascia is illustrated in FIGS. 3*a*–3*e*. In each of this series of figures a fragment of the roof structure is shown in section as comprising a layer 34 of sheet material such as plywood, or the like, and an exterior layer 38 of shingles, although it will be understood that the invention may be employed with a wide variety of conventional roofing materials and constructions. Also, the roof pitch is varied from essentially flat to relatively steep throughout the figures to illustrate operation of the flashing structure when used with various drainage slopes.

Figure 3A:
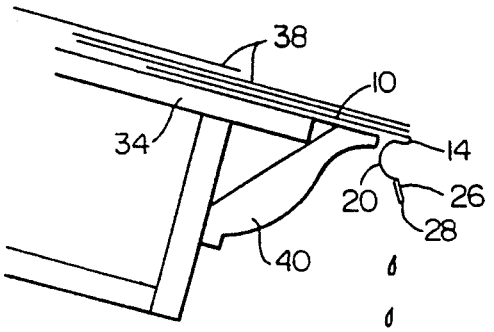
FIGS. 3*a*–3*e* are a series of side elevational views illustrating the manner of installation and operation of the flashing on roof structures with various conventional moldings and with flat fascia, and with different roof pitches.
Figure 3B:
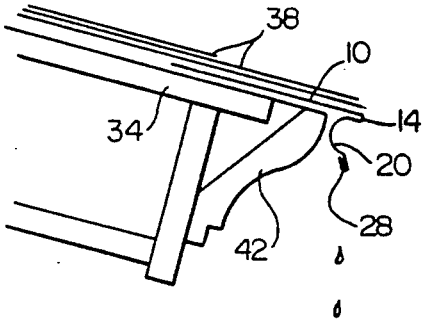

In FIGS. 3*a* and 3*b*, the flashing structure is shown installed on roofs having decorative roof edge moldings 40 and 42 of the types known as Cyma Reversa and Cyma Recta, respectively. It will be noted that when the flashing structure is installed with the rear surface of portion 20 closely adjacent or contacting the molding immediately below the roof line, drainage edge 14 extends a distance outwardly from all structural materials adjacent the roof edge which is at least equal to the straight line distance, measured in a direction parallel to the plane of body portion 10 between the rearwardly directed surface of portion 20 and drip edge 28, indicated in FIG. 2 by dimension D. Distance D be at least ¾", and preferably on the order of 1¼".

Figure 3C:
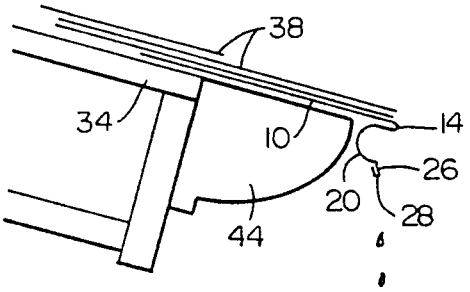
Figure 3D:
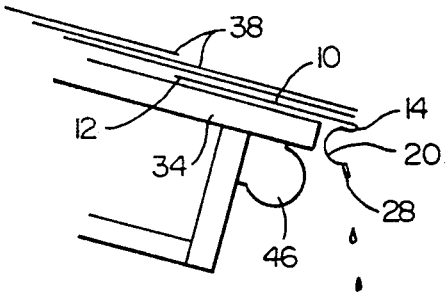
Figure 3E:
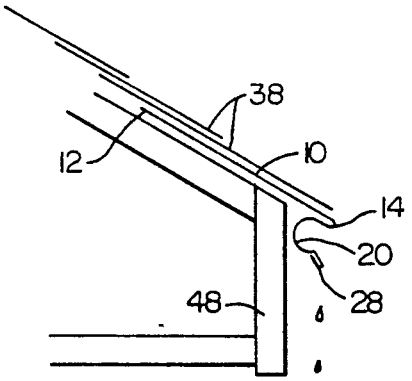

The flashing of the invention is shown in FIGS. 3*c* and 3*d* installed along the horizontal edges of roofs having edge moldings 44 and 46, of Ovolo and bead-type designs, respectively. Again, the configuration of the flashing ensures that drainage edge 14 is positioned at least ¾" outwardly of any structural members which are to be protected from roof run-off. The flashing is shown in FIG. 3*e* installed on a roof with flat fascia 48 immediately below the roof line, with the same effect, i.e., drainage edge 14 is positioned at least ¾" outwardly of the roof edge and/or any exposed structural materials immediately below the roof line.

It will be noted that the angle between plane 18 and the vertical increases with roof pitch. Therefore, in more steeply pitched roofs, e.g., as in FIGS. 3*c*–3*e*, run off falling vertically from drainage edge 14 may not contact portion 26 or drip edge 28.

Relative dimensions of the various portions of the flashing member are such that, when installed on flat or low-pitched roofs, plane 18 intersects the surface of portion 26 at or near edge 28. Thus, particularly with essentially flat or low-pitched roofs, run-off which passes from drain edge 14, even though it may pass slightly around edge 14 and fall horizontally from a position behind this edge, will be intercepted by the upper surface of portion 26 and pass from drip edge 28. Curved portion 20 ensures that drainage edge 14 and drip edge 28 are positioned a sufficient distance outwardly of the roof line and any structural materials immediately below the roof line that run-off from the roof does not contact such materials, eventually causing decay and structural damage which must be repaired.

What is claimed is:

1. A flashing structure for assisting in proper moisture drainage from a horizontal edge of a roof surface, said flashing structure being formed of a unitary sheet of material comprising:

a) a substantially flat body portion having upper and lower sides, a desired length and a width extending from a linear, free edge to a drainage edge parallel with said free edge, said flashing structure being of substantially uniform configuration in all planes perpendicular to said free edge throughout said length;

b) a first portion extending from said drainage edge on the lower side of said body portion in a curve extending toward said free edge, away from said body portion and thence toward a plane perpendicular to said body portion and tangent to said drainage edge with forwardly and rearwardly directed surfaces; and c) a substantially planar, second portion extending integrally from said first portion along a juncture edge to a drip edge, said juncture edge and said drip edge being parallel to one another and to said drainage edge, said third portion having forwardly and rearwardly directed surfaces.

2. The flashing structure of claim 1 wherein said first and second portions are so configured and dimensioned relative to said drainage edge that said plane perpendicular to said body portion and tangent to said drainage edge intersects said forwardly directed surface of said second portion.

3. The flashing structure of claim 2 wherein said first portion extends from said drainage edge to said juncture edge in a curve of substantially uniform radius about a fixed center.

4. The flashing structure of claim 3 wherein said fixed center lies between said plane and said first portion.

5. The flashing structure of claim 4 wherein said first portion extends from said drainage edge to said drip edge approximately 180° about said fixed center.

6. The flashing structure of claim 1 wherein said material is bent at said juncture edge at an angle of less than 90°.

7. The flashing structure of claim 6 and further including a third portion extending from said drip edge in closely superposed relation to said rearwardly directed surface of said second portion.

8. The flashing structure of claim 1 wherein the straight line distance, measured in a direction parallel to the plane of body portion 10, between the rearwardly directed surface of said first portion and said drip edge is at least ¾".

9. The flashing structure of claim 8 wherein said straight line distance is about 1".

10. Flashing structure for installation along a building roof edge, said structure comprising:

a) an elongated unitary sheet metal member having a desired length extending along a linear, free edge, said sheet metal member being of uniform cross section throughout said length in all planes perpendicular to said free edge and including:

b) a substantially flat body portion extending forwardly from said free edge to a drainage edge, parallel to said free edge;

c) a curved portion extending integrally from said drainage edge at a substantially uniform radius about a fixed center point toward said free edge and thence away from said body portion and toward a plane perpendicular to said body portion and tangent to said drainage edge;

d) said curved portion terminating at a juncture edge rearward of said perpendicular plane;

e) a planar portion extending from said juncture edge with forwardly and rearwardly directed surfaces to a drip edge forward of said perpendicular plane, whereby said planar portion is intersected by said perpendicular plane; and f) a portion extending from said drip edge in closely superposed relation to said rearwardly directed surface of said planar portion to a terminal edge.

11. The flashing structure of claim 10 wherein said fixed center point is positioned rearward of said perpendicular plane.

12. The flashing structure of claim 11 wherein said curved portion extends approximately 180° about said center point.

13. The flashing structure of claim 12 wherein said uniform radius is between about $\frac{1}{2}''$ and $\frac{3}{4}''$.

14. The flashing structure of claim 10 wherein the angle between said planar portion and a line tangent to said curved portion at said juncture edge is less than 90°.

* * * * *